US011388947B1

(12) United States Patent
Barnes

(10) Patent No.: US 11,388,947 B1
(45) Date of Patent: Jul. 19, 2022

(54) FRICTION-ADJUSTABLE ROTARY SOLE ATHLETIC SHOE

(71) Applicant: Brooks L. Barnes, The Woodlands, TX (US)

(72) Inventor: Brooks L. Barnes, The Woodlands, TX (US)

( * ) Notice: Subject to any disclaimer, the term of this patent is extended or adjusted under 35 U.S.C. 154(b) by 0 days.

(21) Appl. No.: 17/335,881

(22) Filed: Jun. 1, 2021

(51) Int. Cl.
*A43B 5/02* (2006.01)
*A43B 3/00* (2022.01)
*A43C 15/16* (2006.01)

(52) U.S. Cl.
CPC ..... *A43B 5/02* (2013.01); *A43B 3/0042* (2013.01); *A43C 15/161* (2013.01); *A43C 15/168* (2013.01)

(58) Field of Classification Search
CPC ..... A43B 5/02; A43B 5/12; A43B 3/0042; A43C 15/161
See application file for complete search history.

(56) References Cited

U.S. PATENT DOCUMENTS 3,354,561 A * 11/1967 Cameron ..... A43B 3/0042 482/146
3,481,332 A 12/1969 Arnold
3,707,047 A 12/1972 Nedwick
3,739,497 A 6/1973 Cameron
5,682,689 A * 11/1997 Walker ..... A43B 21/433 36/134
7,757,413 B2 7/2010 Anderson
8,074,376 B1 12/2011 Teteriatnikov
8,104,193 B1 1/2012 Teteriatnikov
8,341,855 B2 1/2013 Teteriatnikov
2010/0311514 A1* 12/2010 Antolick ..... A43B 3/0042 473/217

FOREIGN PATENT DOCUMENTS

CN 200950850 Y 9/2007
GB 2392604 A * 3/2004 ..... A43B 3/0042
GB 2506694 A * 4/2014 ..... A43B 3/0042

* cited by examiner

*Primary Examiner* — Ted Kavanaugh
(74) *Attorney, Agent, or Firm* — Keeling Law, LLC; Kenneth A. Keeling; Mark S. Solomon

(57) ABSTRACT

Embodiments of an athletic shoe of the present invention generally include a cooperating rotor assembly and torque-dampening system, wherein the rotor assembly includes a substantially round rotor equipped with a plurality of cleat members and having a plurality of teeth about the outer circumference thereof, and the torque-dampening system includes a compressible device configured and adapted to interact with the rotor teeth. Embodiments of a method of using embodiments of an athletic shoe of the present invention are also provided.

20 Claims, 8 Drawing Sheets

FRICTION-ADJUSTABLE ROTARY SOLE ATHLETIC SHOE

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention generally relates to footwear. More particularly, embodiments of the present invention are directed to athletic footwear equipped with a rotational positioning mechanism.

BACKGROUND OF THE INVENTION

In outdoor field sports like soccer and football, participants are required to accelerate and decelerate quickly, placing strains on the knees. Sudden changes in direction, or the application of force, by participants, place stresses on both the ankle and the knee. Not infrequently, an injury, such as a strain or tear to a ligament or tendon occurs.

For decades, prior art in football and soccer cleated shoes ("cleats") has focused upon a fixed, molded plastic or nylon sole. While a great amount of effort has been directed at the appearance and styling of the upper shoe, little effort or ingenuity has been applied to improve the inherent safety problems associated with wearing the cleated sole, regarding to injuries to the ankle, knee and hip. Cleats were invented more than a century ago to anchor an athlete's foot to the ground and prevent slipping on a grass or dirt field. When anchored to the ground by a cleat or stud, however, the wearer's ankle, knee and/or hip can be forced by that athlete's weight and motion to torque or bend beyond his or her inherent flexibility, leading to injuries to tendons and cartilage. Importantly, such injuries may never fully heal and can become life-long impairments. Additionally, once a player's shoe cleat has penetrated the ground, it remains locked in that position, until the next step. Should an opposing player strike the anchored leg or foot, the athlete will take a blow that can easily force the ankle, knee or hip to flex in a dangerously un-natural direction. The number of joint-related injuries at every age-level of football is testimony to this phenomenon. Fixed athletic cleats then, have an inherent flaw—the same functionality that anchors them to the ground impedes the wearer's body from pivoting in the direction of an applied force to absorb a lateral blow and, potentially, avoid injury.

There has, however, been some activity in the field of cleat design. Athletic shoes with rotatable cleat plates or turntables have been previously disclosed. Such disclosures include U.S. Pat. Nos. 3,354,561 and 3,739,497 to Cameron; U.S. Pat. No. 3,481,332 to Arnold; and U.S. Pat. No. 3,707,047 to Nedwick, which patents are incorporated by reference herein in their entireties. Therein is disclosed, inter alia, adoption of circular, rotating plates beneath the metatarsal region (the ball of the foot), that allow a player to plant and immediately pivot, thereby removing a great deal of the torsion imposed on the ankle, knee and/or hip. Said rotation then, permits a player's leg to adjust to a position nearer to is natural state and mitigate joint-stressing forces that are inherent in the quick, directional changes of football and soccer. These prior art shoes suffer from several disadvantages including weight and complexity, and, very importantly, free rotation; that is, upon a player's change in direction, the shoe's rotating element freely rotates without any significant resistance to rotation. Such free rotation can, in fact, be detrimental, as over rotation can itself produce a much larger amount of torque on the player's joints than is desired and therefore result in injury.

U.S. Pat. No. 5,682,689 to Walker et al. and U.S. Pat. No. 7,757,413 to Anderson, both of which are incorporated by reference herein in their entireties, attempt to deal with the issue of free rotation. The means of rotational resistance disclosed therein, magnetic force in Anderson and an angle-activated braking member in Walker et al., however, are not entirely satisfactory. In Chinese Patent No. CN200950850Y to Wu ("Wu"), a substantially flat-soled shoe having a rotary control mechanism utilizing a turntable system with at least two small, rolling balls that run in smooth grooves, in conjunction with torsion springs attached to two internal plates, is disclosed. Importantly, in the shoe disclosed in Wu, a torsion spring limits the degree of rotation of the rotating apparatus.

BRIEF SUMMARY OF THE INVENTION

Embodiments of an apparatus of the present invention generally include an athletic shoe comprising a cooperating rotor assembly and torque-dampening system. In one embodiment, the rotor assembly comprises a substantially round rotor equipped with a plurality of cleat members, wherein the rotor comprises a plurality of teeth about the outer circumference thereof. In one embodiment, the torque-dampening system comprises a compressible device configured and adapted to interact with the rotor teeth. Embodiments of a method of using embodiments of an apparatus of the present invention are also provided.

BRIEF DESCRIPTION OF THE DRAWINGS

For a more complete understanding of the present invention, reference is now made to the accompanying drawings, in which.

DETAILED DESCRIPTION OF EXEMPLARY EMBODIMENTS OF THE INVENTION

Figure 1:
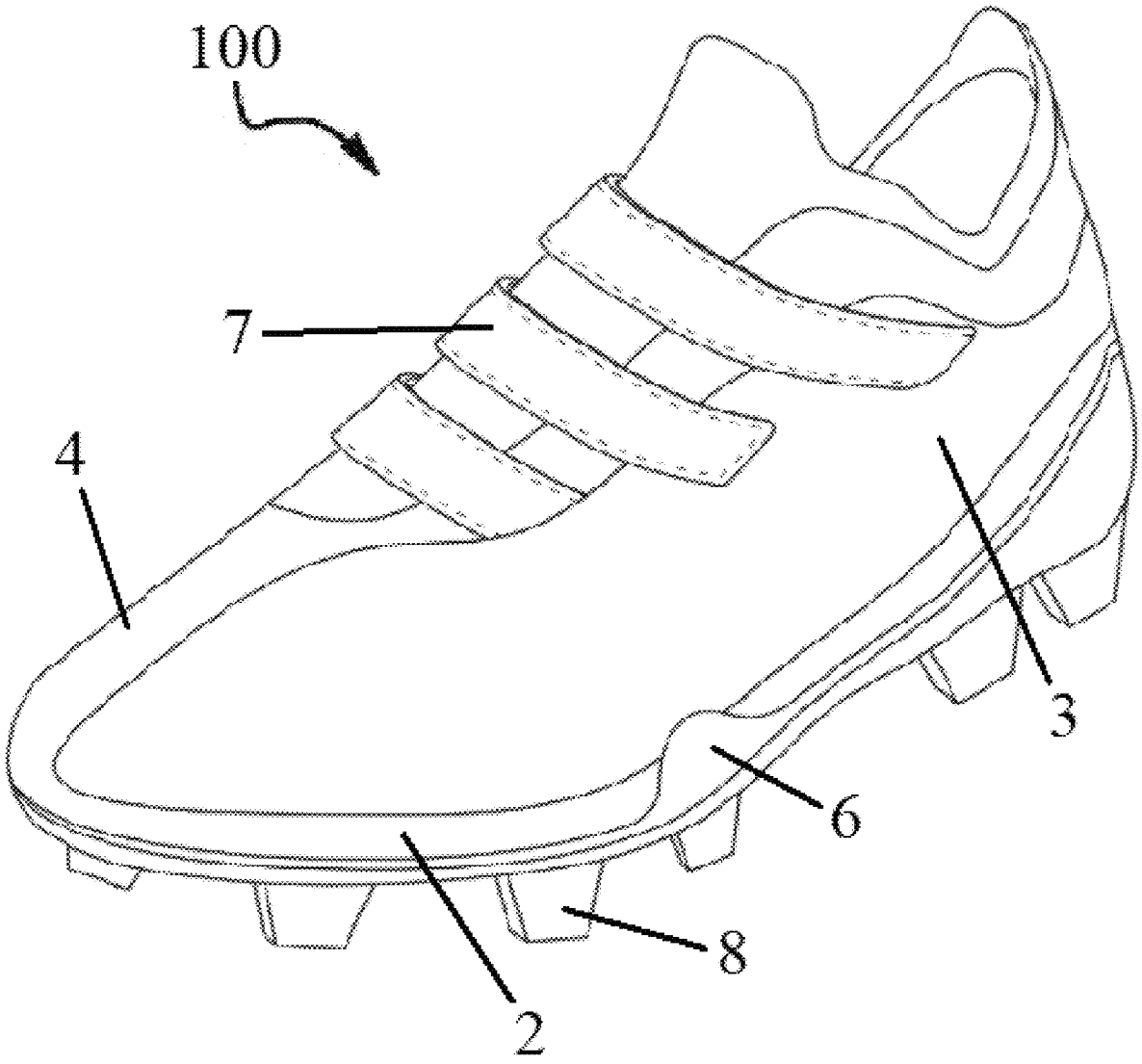
FIG. 1 is a top perspective view of an embodiment of an athletic shoe of the present invention.

The exemplary embodiments are best understood by referring to the drawings, like numerals being used for like and corresponding parts of the various drawings. In the following description of embodiments, orientation indicators such as "top," "bottom," "up,' "down," "upper," "lower," "front," "back," etc. are used for illustration purposes only; the invention, however, is not so limited, and other possible orientations are contemplated.

Referring first to FIG. 1, an embodiment of an athletic shoe 100 is depicted. In the embodiment shown in FIG. 1, an athletic shoe 100 comprises an outsole 2, and an upper section 3, wherein the upper section 3 comprises a toe guard section 4, a fastening mechanism 7, and a lateral support wall 6. In various embodiments, the upper 3 is constructed of a first material which may be leather, a faux leather, a heavy or woven fabric, a molded carbon fiber, a polyurethane (PU), a thermoplastic polyurethane (TPU) or other useful material. In one embodiment, the toe guard 4 covers the toe box area (not separately labeled) and is reinforced with multiple layers of the first material. In one embodiment, the toe guard 4 may comprise a thin layer of plastic or rubber or other wear-resistant material for added protection. The fastening mechanism 7, which assists in maintaining the athletic shoe 100 on the wearer's foot, may comprise, straps, buckles, shoelaces with eyelets, or any standard shoe-fastening mechanism, as would be understood by one skilled in the art. In the embodiment depicted in FIG. 1, the fastening mechanism 7 comprises a Velcro® mechanism utilizing straps comprising hooks (not separately labeled) and an exterior shoe surface comprising hoops (not visible in FIG. 1). Although the athletic shoe 100 depicted in FIG. 1 (at least in the portion of the shoe shown in FIG. 1) generally represents a standard football or soccer cleated shoe, the invention is not so limited, and in various other embodiments (not shown), an athletic shoe 100 of the present invention may comprise any athletic shoe, including, but not limited to, a cleated shoe for baseball, softball, lacrosse, rugby, golf, or track. In other embodiments (not shown), an athletic shoe 100 of the present invention may comprise a non-cleated shoe, including, but not limited to, a shoe for basketball, volleyball, tennis, track, walking, hiking or dancing.

Figure 2:
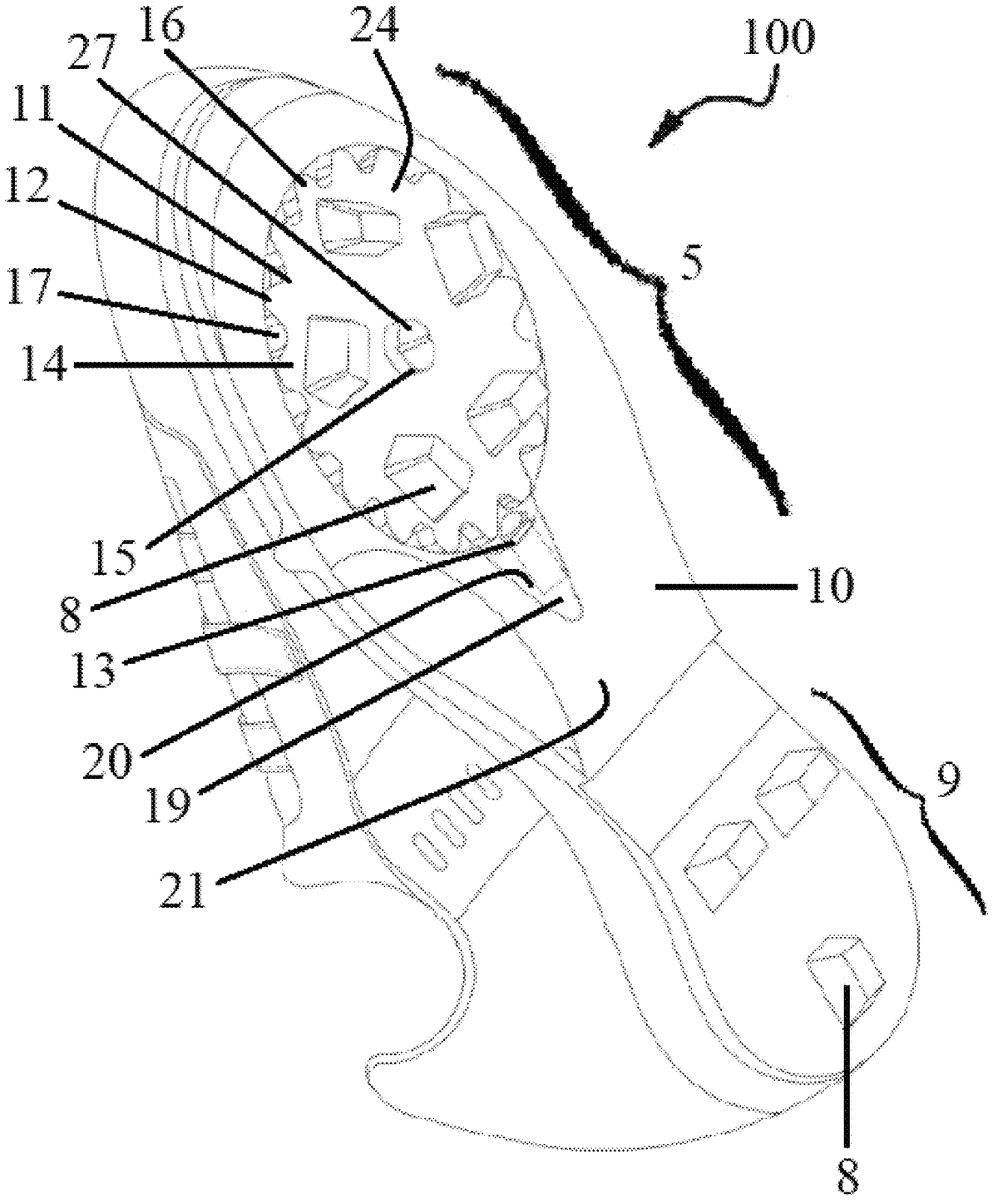
FIG. 2 is a bottom perspective view of an embodiment of an athletic shoe of the present invention.

Referring now to FIG. 2, a bottom 10 of an embodiment of an athletic shoe 100 is depicted. In the embodiment shown in FIG. 2, the athletic shoe 100 comprises one or more cleats (protrusions on the sole of a shoe) 8 within of proximate a heel area 9. In other embodiments (not shown), a heel area 9 of an athletic shoe 100 may not comprise any cleats. In the embodiment of FIG. 2, the heel cleats 8 are immovably affixed to the bottom 10 of the athletic shoe 100, although the invention is not so limited and one or more heel cleats 8 may be integral to athletic shoe 100 bottom 10 and/or rotatable or otherwise capable of movement independent of the rest of athletic shoe 100. In one embodiment, bottom 10 cleats 8 may be reversibly affixed thereto by means of screws or other attachment means, as would be understood by one skilled in the art.

Figure 3A:
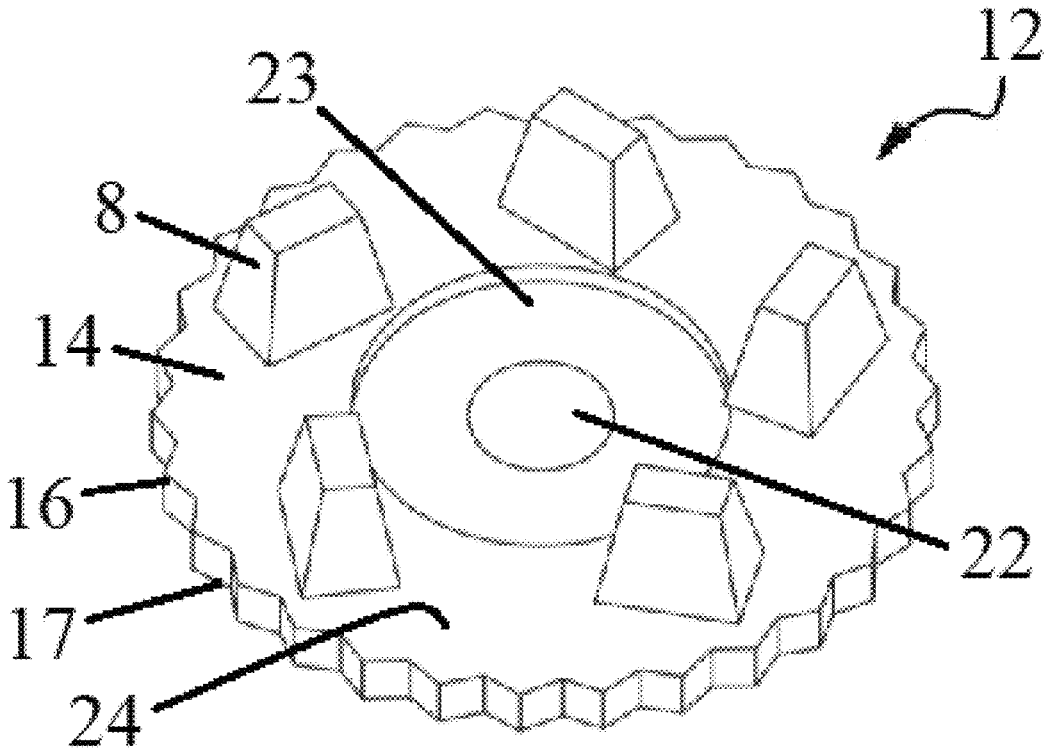
FIG. 3A is a perspective view of an embodiment of a rotor of the present invention.
Figure 6:
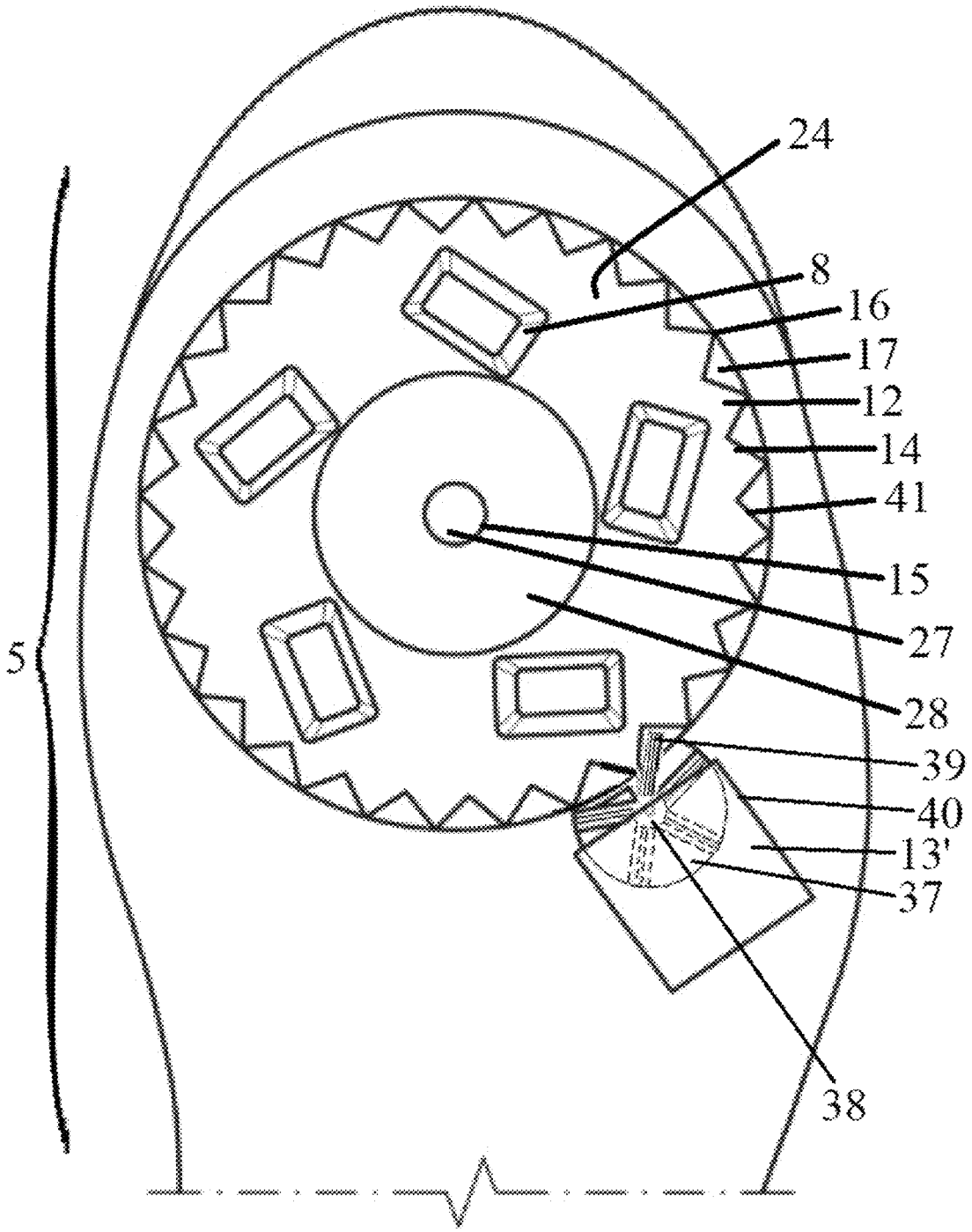
FIG. 6 is a close-up view of the sole section of an embodiment of an athletic shoe of the present invention.

Still referring to the embodiment depicted in FIG. 2, an athletic shoe 100 bottom 10 is equipped with a torque-dampened rotational system 11 positioned at least partially within a forward portion 5 thereof. In one embodiment, rotational system 11 comprises a rotor assembly 12 (shown in additional detail with respect to FIGS. 3A, 3B and 4B, below), and a torque-dampening apparatus 13. In one embodiment, rotor assembly 12 comprises a rotor 14, one or more cleats 8, and an attachment apparatus 15. In one embodiment, a rotor 14 may comprise a sprocket-like geometry having a plurality of teeth (cogs) 16 spaced about the perimeter of rotor 14. In such an embodiment, there exist a plurality of spaces 17 between adjacent teeth 16. Although the teeth 16 are depicted in FIG. 2 as being rounded and substantially evenly spaced apart, the invention is not so limited and other geometries and/or spacing may be employed. In one aspect, such as depicted in FIGS. 3A and 6 described below, teeth 16 may be have a substantially triangular geometry. In addition, while the teeth 16 shown in the embodiment of FIG. 2 are substantially identical in size, shape and spacing, the invention is not so limited and other relative sizing, shape and/or spacing relationships of and/or between teeth 16 may be employed, as would be understood by one skilled in the art. In other embodiments (not shown), at least a portion of a circumferential edge 41 of a rotor 14 may comprise other types of protrusions (rather than teeth 16), such as, but not limited to, elongated members.

Figure 4A:
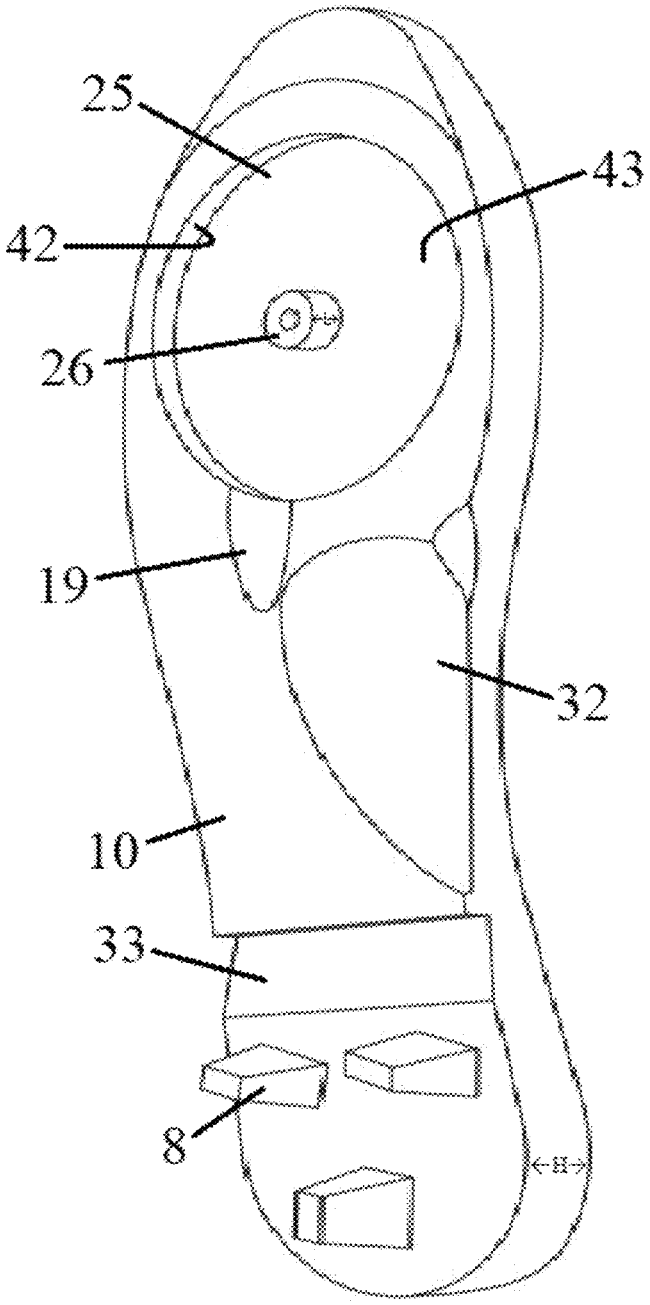
FIG. 4A is a bottom perspective view of a portion of an embodiment of an athletic shoe of the present invention.
Figure 4B:
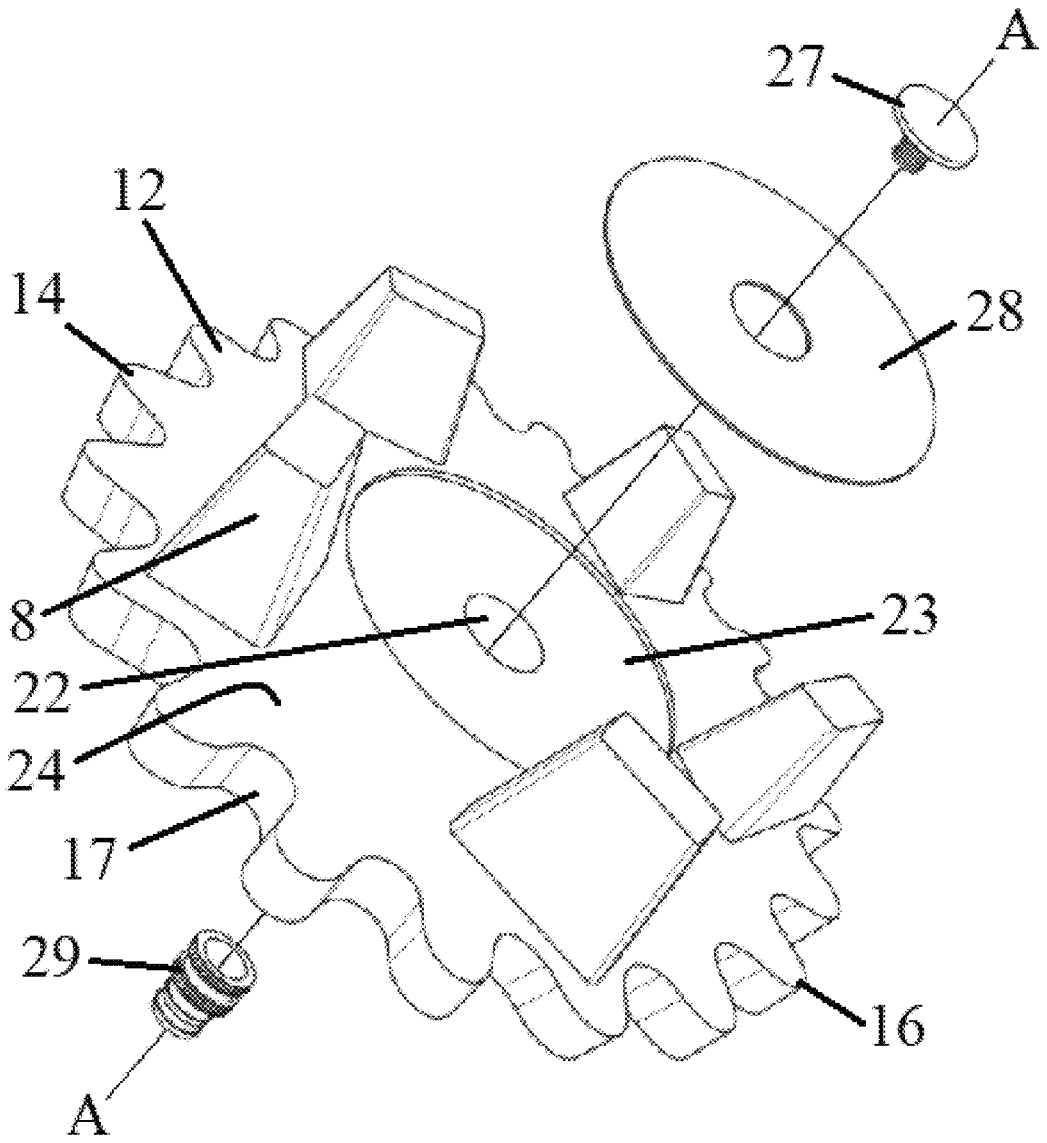
FIG. 4B is an exploded view of an embodiment of a rotor and rotor attachment mechanism of the present invention.

In the FIG. 2 embodiment, the attachment apparatus 15 (a portion of which is visible in FIG. 2) comprises a reversibly attachable component 27, such as a screw, that comprises a threading (male or female) that is engaged with a complementary male or female threaded attachment component 29 (see FIG. 4B). In one aspect, such reversible attachment allows for removal and/or replacement of a rotor assembly 12. In other embodiments (not shown), a rotor assembly 12 may be irreversibly attached to or integral with a shoe bottom 10. In various embodiments, an attachment apparatus 15 may comprise a single component or it may comprise a plurality of components. In one aspect, an attachment apparatus 15 and rotor 14 are adapted and configured such that rotor assembly 12 can rotate about the longitudinal axis (labeled A-A in FIG. 4A) of attachment apparatus 15. In the embodiment shown in FIG. 2, during rotation of rotor assembly 12, attachment apparatus 15 does not itself rotate; however, the invention is no so limited and in other embodiments (not shown) an attachment apparatus 15 and rotor assembly 12 are adapted and configured such that at least a portion of the attachment apparatus 15 rotates when rotor assembly 12 rotates. Although the embodiment of FIG. 2 depicts attachment apparatus 15 as protruding from an upper surface 24 of rotor 14, the invention is not so limited, and in other embodiments a top surface 31 of an attachment apparatus 15 may be substantially co-planar with upper surface 24; i.e., attachment apparatus 15 may be countersunk with respect to upper surface 24.

Also depicted in the embodiment of FIG. 2 is a torque-dampening apparatus 13. Although the embodiment of an athletic shoe 100 depicted in FIG. 2 shows a single torque-dampening apparatus 13, in other embodiments (not shown), an athletic shoe 100 may comprise a plurality of torque-dampening apparatuses 13. In one aspect, a torque-dampening apparatus 13 functions to provide resistance to the rotation of rotor assembly 12. In the embodiment shown in FIG. 2, torque-dampening apparatus 13 is positioned on shoe bottom 10 between rotor assembly 12 and heel area 9; however, the invention is not so limited and the one or more torque-dampening apparatuses 13 may be positioned anywhere useful along, or at least partially embedded within, shoe bottom 10.

Figure 5A:
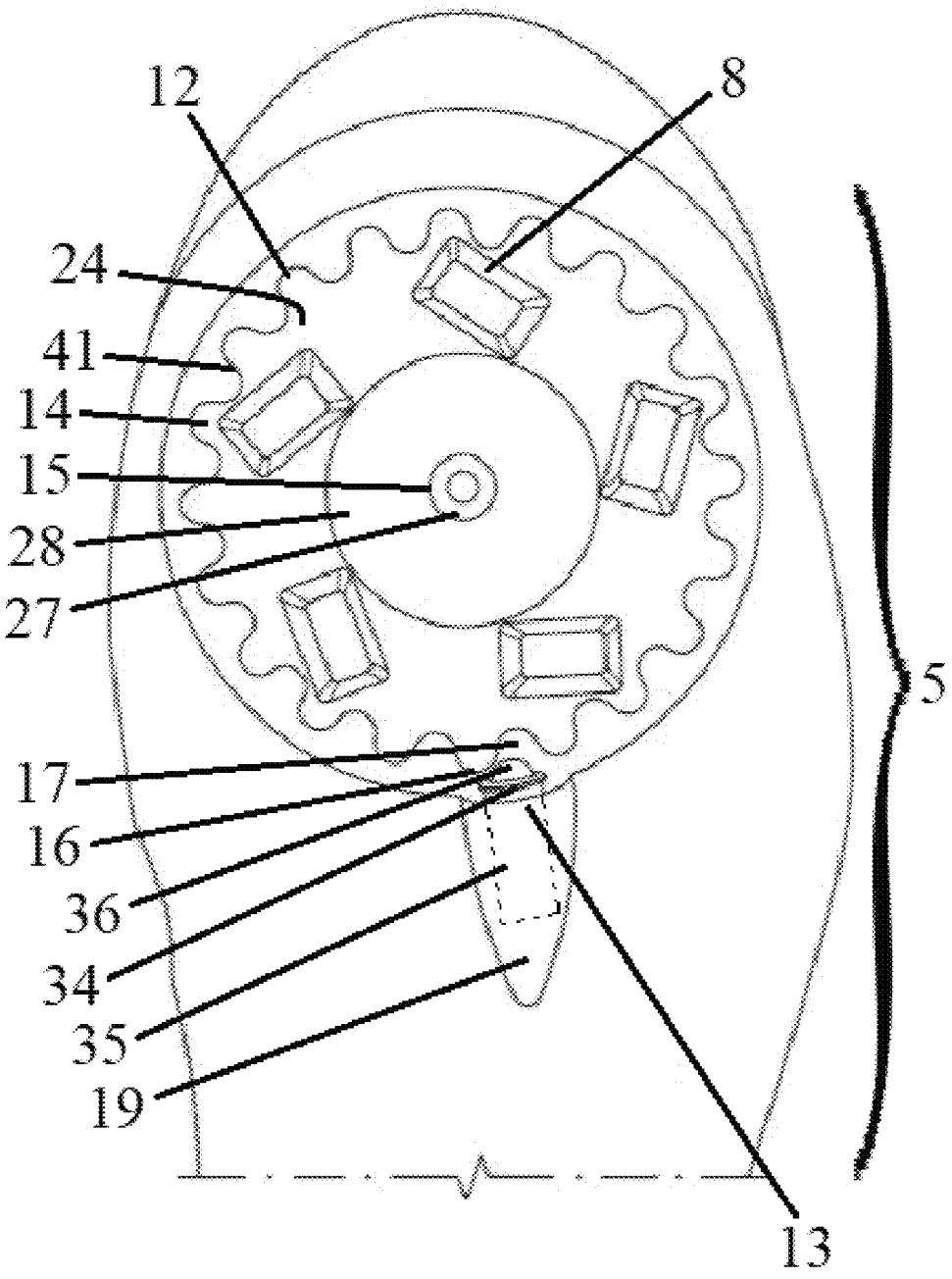
FIG. 5A is a close-up view of the sole section of an embodiment of an athletic shoe of the present invention.
Figure 5B:
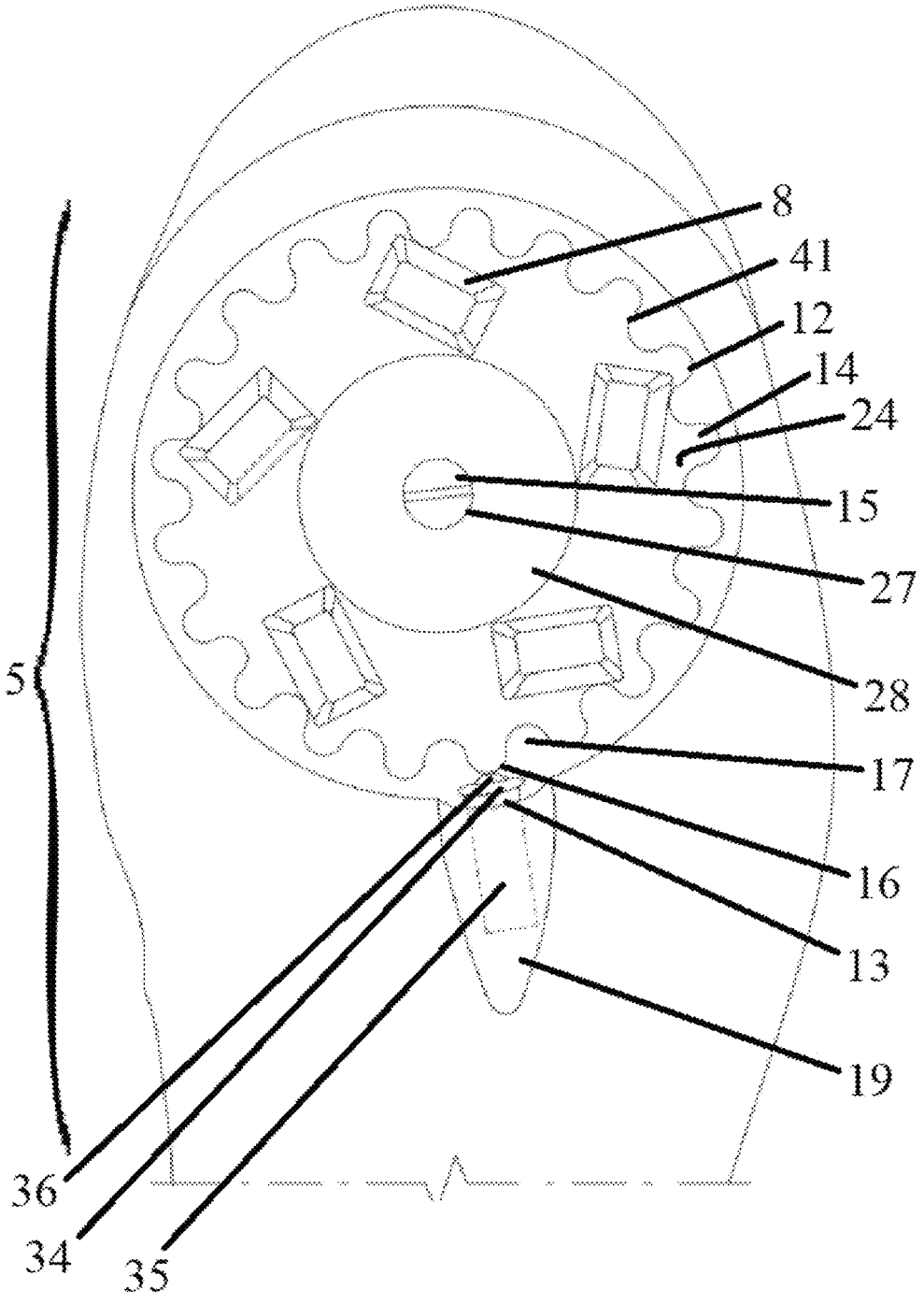
FIG. 5B is a close-up view of the sole section depicted in FIG. 5A having been rotated.

Still referring to FIG. 2, torque-dampening apparatus 13, which is described in greater detail below with regard to FIGS. 5A and 5B, is at least partially disposed within a pocket 19. In one aspect, a pocket 19 may be adapted and confiture to provide protection to at least a portion of a torque-dampening apparatus 13. In one embodiment, a pocket 19 may be configured and positioned such that at least a portion of a bottom surface 20 thereof is substantially co-planar with portion of a surface 21 of shoe bottom 10 proximate thereto. In one aspect, a pocket 19 may comprise any shape and/or dimensions useful in housing or partially housing a torque-dampening apparatus 13.

Figure 3B:
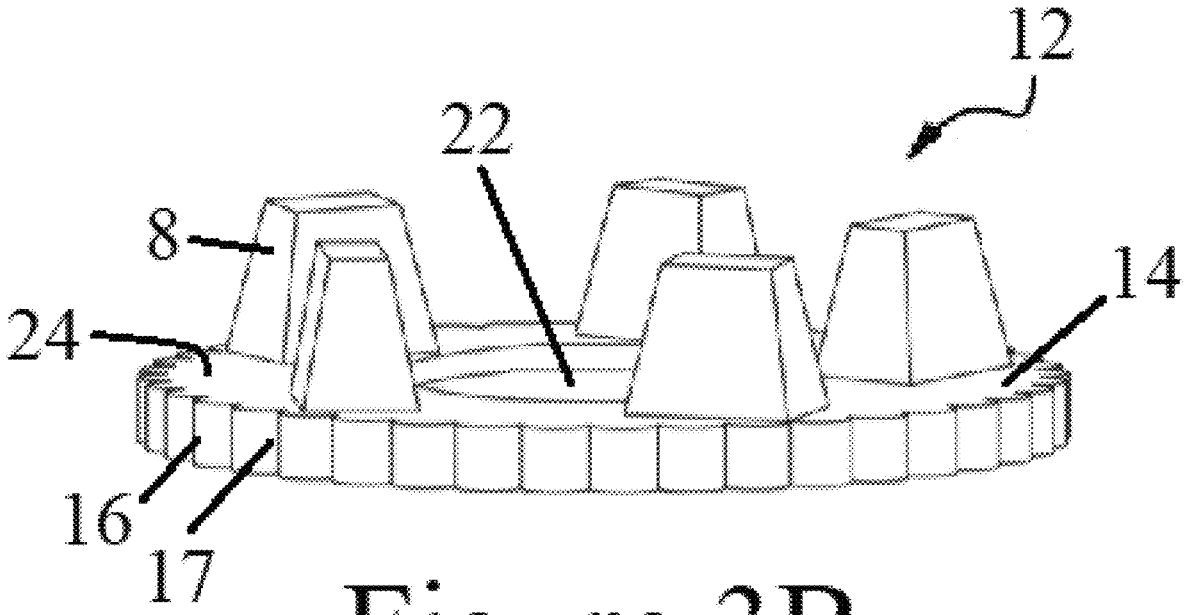
FIG. 3B is a side view of an embodiment of a rotor of the present invention.

Referring now to FIGS. 3A and 3B, an embodiment of a rotor assembly 12 is depicted from a perspective view and a side view, respectively. As shown in FIGS. 3A and 3B, in one embodiment a rotor assembly 12 comprises a rotor 14 and cleats 8, wherein rotor assembly 12 comprises a central opening 22 extending therethrough. In one embodiment, a rotor assembly 12 may comprise a recessed area 23 in a rotor 14 upper surface 24 that is positioned circumferentially about central opening 22. In another embodiment (not shown), a rotor assembly 12 may comprise a recessed area in a rotor 14 bottom surface that is positioned circumferentially about central opening 22. In the embodiment of FIGS. 3A and 3B, rotor 14 comprises a plurality of teeth 16 and spaces 17 therebetween.

In various embodiments (not shown), a rotor assembly 12 does not comprise cleats. In one aspect, in such an embodiment a rotor assembly 12 may comprise a high-friction rotor 14 upper surface 24. Such an embodiment may be useful for employment in indoor sports, such as basketball, volleyball, cheerleading, or the like, where traction is helpful, but protection of the playing surface (or some other factor) dictates that cleats cannot be worn. In other such embodiments, a rotor assembly 12 may comprise a low-friction rotor 14 upper surface 24. Such an embodiment may be useful for employment in indoor activities such as dancing, where the pivoting capabilities of an athletic shoe 100 are desired for certain wearer movements wherein traction relative to shoe bottom 10 forward portion 5 is not desired.

Referring now to FIG. 4A, the bottom 10 of an embodiment of an athletic shoe 100 wherein the rotor assembly 12 is not installed is depicted. In one embodiment, shoe bottom 10 comprises a rotor assembly socket (hollow) 25 that is configured and adapted to at least partially house a rotor assembly 12. In one embodiment, centralized within rotor assembly socket 25 is a rotor assembly attachment member (hub) 26. In one embodiment, a hub 26 may provide an attachment mechanism for reversibly or irreversibly affixing a rotor assembly 12 to shoe bottom 10. In one embodiment, a hub 26 length L is substantially equal to a heel area 9 height H.

FIG. 4B is an exploded view of an embodiment a rotor assembly 12 and means for attaching the rotor assembly 12 to shoe bottom 10. In various embodiment, such attachment means comprise an attachment apparatus 15 (not separately labeled in FIG. 4B). In one embodiment, such attachment apparatus 15 may include one or more of a connection component 27, a pressure distribution member 28, and a hub receptacle 29. In one embodiment, a connection component 27 may comprise external threading (not separately labeled), e.g., a screw or bolt. In one embodiment, a pressure distribution member 28 may comprise one or more washers. In one embodiment, a pressure distribution member 28 to be at least partially inserted into a recessed area 23. In one embodiment, a hub receptacle 29 may be affixable to, or integral with, hub 26. In one embodiment, a hub receptacle 29 may comprise internal threading (not shown) that allows for screwed engagement of an externally threaded connection component 27 therewith.

In one embodiment (not shown), an attachment apparatus 15 comprises a push-type retainer clip. In one such embodiment, a connection component 27 comprises a push-type retainer clip (such as, but not limited to, the type of clip commonly used to secure vehicle engine component covers) which is reversibly insertable at least partially into rotor assembly 12 central opening 22. In one embodiment, the push-type retainer clip is adapted and configured to engage a hub receptacle 29, however, the invention is not so limited and other means for reversible engagement of the push-type retainer clip with shoe bottom 10 may be employed, as would be understood by one skilled in the art.

Utilizing the shoe bottom 10 features shown in FIG. 4A and the attachment means depicted in FIG. 4B, a rotor assembly 12 can be attached to a cleated athletic shoe 100. Importantly, as would be understood by one skilled in the art, various attachment items/systems may be utilized to attach, reversibly or irreversibly, a rotor assembly 12 to a cleated athletic shoe 100. In other embodiments (not shown), a rotor assembly 12 (or portions thereof) may be integral to a cleated athletic shoe 100.

Referring again to FIG. 4A, an athletic shoe 100 bottom 10 may comprise a parabolic arch depression 32. In one aspect, employment of a parabolic arch depression 32 allows for provision of an athletic shoe 100 comprising a thinner outsole 2, which may improve shoe flexibility. In one embodiment, an athletic shoe 100 bottom 10 may comprise a beveled portion 33 forward of heel area 9. In one aspect, employment of a beveled portion 33 may improve shoe flexibility and facilitate heel implantation during backward movements of the wearer.

Referring now to FIG. 5A, a close-up view of an embodiment of an installed rotor assembly 12 in operational cooperation with a torque-dampening apparatus 13 is depicted. In one aspect, a torque-dampening apparatus 13 comprises any mechanism for partially impeding (i.e., "braking") rotation of rotor 14. In one embodiment, a torque-dampening apparatus 13 comprises a compression mechanism (not separately labeled) that allows an engagement section 34 of torque-dampening apparatus 13 to be compressed when subjected to a contacting force. In one such embodiment, a torque-dampening apparatus 13 may comprise a device such as, but not limited to, a ball plunger. In one embodiment, a ball plunger 13 comprises a cylindrical section 35, a spherical component (ball) 36 (a portion of which comprises engagement section 34), and a compressible member (not visible) positioned longitudinally within cylindrical section 35, as would be understood by one skilled in the art. In one embodiment, such a compressible member may comprise a coiled spring, although the invention is not so limited and the compressible member may comprise any elastic element that stores mechanical energy, such as, but not limited to, a rubber or elastomeric material. In one embodiment, the elastic element may comprise a compressible fluid. In one aspect, the compressible member may bias the ball 36 toward the rotor 14. In certain embodiments, the compression resistance of a compressible member may be between about 0.5 pounds and about 20 pounds. In other embodiments (not shown), wherein a torque-dampening apparatus 13 does not comprise a ball plunger, any suitable device for "braking" rotation of rotor 14 may be employed. (See, e.g., FIG. 6, described below).

As is generally known, in a standard ball plunger 13 the ball 36 is maintained only partially within cylindrical section 35, and the ball 36 is also maintained in biased contact with the compressible member (not visible) positioned longitudinally within cylindrical section 35. When a force is applied to any portion of the ball 36 that is disposed outside of cylindrical section 35, such the force transferred via the ball 36 begins to compress the compressible member, an additional portion of ball 36 is provided into cylindrical section 35, thereby decreasing the volume of ball 36 that is disposed outside of cylindrical section 35. In the embodiment depicted in FIG. 5A, when the rest of athletic shoe 100 is rotated in a clockwise direction (and the rotor assembly 12 is held stationary, such as by the cleat(s) 8 being engaged with a playing surface), a portion of the indicated tooth 16 contacts the ball 36. If the rotational force of the ball 36 against the tooth 16 is sufficient, the ball 36 compresses the compressible member (not visible) and a portion of the ball 36 retracts into the cylindrical section 35 such that the athletic shoe 100 is able to continue its clockwise rotation, as depicted in FIG. 5B. Further clockwise rotation of the rest of the athletic shoe 100 (not shown) will result in the engagement portion 34 of ball 36 being lined up with the space 17 indicated in FIG. 5B, whereby the compressible member will force ball 36 at least partially into that space 17. In one aspect, in this manner the torque-dampening apparatus 13 acts to restrict rotation of the athletic shoe 100 to any pivoting movement that provides sufficient force for one or more teeth 16 to engage and compress the compressible member (via the ball) enough for the ball 36 to retract into the cylindrical section 35 such that the engagement portion 34 rotates beyond the tooth/teeth. In various embodiments (not shown), a torque-dampening apparatus 13 may be adjustable, whereby the compression strength (biasing force) of the compressible member may be varied so as to change the amount of force that is necessary to compress the compressible member sufficiently to allow rotation of the rotor in relation to the torque-dampening apparatus 13. In one embodiment, an athletic shoe 100 of the present invention is adapted and configured such that the rotation of a rotor 14 is not limited; i.e., as long as the wearer of the athletic shoe 100 supplies sufficient rotational force to allow the rest of the athletic shoe 100 to rotate, the rest of athletic shoe 100 will continue to rotationally pivot. In one exemplary aspect, this allows the wearer to pirouette, if desired.

In various embodiments (not shown), a torque-dampening rotational system 11 is adapted and configured such that complete rotation (i.e., 360° rotation) of athletic shoe 100 with respect to rotor 14 can be prevented. In one such embodiment, one or more teeth 16 (or other protrusion expending outward from rotor 14 circumferential edge 41) extends outward from circumferential edge 41 farther than the other teeth 16 (or other protrusions). In one such embodiment, when a portion of such a farther extending tooth/protrusion contracts engagement portion 34, it contacts the ball 36 in a manner that does not actuate the ball plunger 13 (i.e., the ball 36 does not compress the compressible member), and rotation of rotor 14 relative to the rest of athletic shoe 100 stops. In another such embodiment, the ball plunger 13 is configured such that contact between a portion of such a farther extending tooth/protrusion contracts engagement portion 34 in such a manner that does actuate the ball plunger 13 (i.e., the ball 36 does compress the compressible member), and the relative rotation of the rotor 14 in relation to the rest of the athletic shoe 100 continues until the farther extending tooth/protrusion contacts a stop member. In one such embodiment, one or more stop members are affixed to (reversibly or irreversibly), or are integral with, shoe bottom 10 peripherally to socket 25. In one such embodiment a stop member may comprise a protrusion extending outward from shoe bottom 10 surface 21. In one embodiment, such a stop member may comprise an actuatable component, such as, but not limited to, a "push-button" component that can be toggled to extend outward from surface 21 (to act a stop) or retract at least partially beneath surface 21 (to not act as a stop and allow rotor 14 rotation there past). As would be understood b one skilled in the art, such embodiments of a stop member are only exemplary and other geometries, orientations and/or configurations may be employed.

In other embodiments of a torque-dampened rotational system 11 (not shown), at least a portion of the torque-dampening force may be provided by frictional interaction between at least a portion of rotor 14 circumferential edge 41 and at least a portion of torque-dampening apparatus 13 engagement portion 34. In such an embodiment, at least a portion of circumferential edge 41 and/or engagement portion 34 comprises a surface or surface feature that promotes frictional interaction therebetween. In such an embodiment, a circumferential edge 41 may or may not comprise protrusions or other surface irregularities. In one such embodiment, the torque-dampening frictional interaction may be provided by a Velcro® mechanism, wherein circumferential edge 41 comprises hooks and engagement portion 34 comprises hoops, or vice versa.

FIG. 6 depicts a close-up view of an embodiment of an installed rotor assembly 12 in operational cooperation with a torque-dampening apparatus 13'. In this embodiment, the torque-dampening apparatus 13' (shown partially in phantom) comprises a torque-dampening unit 37, which comprises a central member 38 and a plurality of paddles 38, at least one of which is positioned at least partially outside of a torque-dampening unit 37 enclosure 40. In other embodiments (not shown), an enclosure 40 may be configured and positioned such that the paddles 39 are maintained there within. In one embodiment, torque-dampening unit 37 is adapted and configured such that rotation of athletic shoe 100 causes at least a portion of a tooth 16 to engage a paddle 39 that is disposed at least partially outside of enclosure 40, such that all paddles 39, including the engaged paddle 39, which are affixed to, or integral with, central member 38, rotate thereabout. In one embodiment, a torque-dampening unit 37 may be configured such that an athletic shoe 100 rotation that causes a paddle 39 to advance to a position within enclosure 40 results in another paddle 39 being positioned between two teeth 16. In one aspect, central member 38 functions to provide resistance to rotational movement of paddles 39 thereabout.

In one embodiment (not shown), a torque-dampening unit 37 may comprise a single paddle 39. In one such embodiment, the paddle 39 may be affixed to, or integral with, a stationary central member 38, but the invention is not so limited and the paddle 39 may be alternatively affixed to, or integral with, a torque-dampening unit 37. In such embodiments, when rotation of athletic shoe 100 effectuates engagement of a paddle 39 with a tooth 16, the paddle 39 deflects away therefrom, and when sufficient deflection has occurred such that the paddle 39 is able to move past the engaged tooth 16, the paddle 39 "swings" back into its initial orientation, and can engage either the adjacent tooth 16 (if the rest of athletic shoe 100 rotation continues in the same direction) or the opposite side of the same tooth 16 (if the rest of the athletic shoe 100 begins to rotate in the reverse direction).

In various embodiments (not shown), resistance to rotation is provided by a plurality of protrusions (or other frictional, resistance-causing features) extending radially outward from rotor 14 circumferential edge 41 and/or a plurality of protrusions (or other frictional, resistance-causing features) extending outward from engagement portion 34 of torque-dampening apparatus 13. In other embodiments (not shown), a plurality of protrusions (or other frictional, resistance-causing features) may extend outward from a circumferential socket 25 inner surface 42 (identified in FIG. 4A), wherein the rotor 14 circumferential edge 41 may engage therewith. In other embodiments (not shown), the torque-dampening mechanism may be at least partially housed beneath the rotor 14. In such an embodiment, a plurality of protrusions (or other frictional, resistance-causing features) may be at least partially housed within shoe bottom 10 socket 25, such as, but not limited to, attached to or integral with a surface 43 of socket 25 (identified in FIG. 4A). In such an embodiment, a plurality of protrusions (or other frictional, resistance-causing features) may be disposed on a bottom surface of rotor 14 (not visible in FIG. 4B). In such embodiments, the engaging protrusions (or other frictional, resistance-causing features) may be disposed, oriented, configured and adapted such that when sufficient rotational force is applied by the athletic shoe 100 wearer, the engaging "members" may overcome the frictional forces of engagement and allow the rest of the athletic shoe 100 to rotate relative to the rotor assembly 12 (which in some embodiments with be indicated by a "clicking" of engaging members), which if/once the rotational force applied by the athletic shoe 100 wearer is not sufficient, the rest of the athletic shoe 100 will not rotate relative to the rotor assembly 12.

In other embodiments (not shown), a torque-dampening apparatus is located beneath the rotor assembly 12, and is disposed at least partially within socket 25. In one such embodiment, the torque-dampening apparatus comprises a compressible component, such as, but not limited to, a coil spring. In one embodiment, the coil spring is positioned annularly about a hub (such as, but not limited to, a hub 26), and is compressingly sandwiched between socket 25 surface 43 and a bottom surface of rotor 14. In such an embodiment, the compressive force applied by biasing of the coil spring against the bottom surface of rotor 14 can provide the torque-dampening effect on the rotor assembly 12. In one such embodiment, the rotor assembly 12 is attached to shoe bottom 10 utilizing a connective component 27, such as, but not limited to, a screw, and, optionally, a pressure distribution member 28, such as, but not limited to, a washer. In one aspect, the screw may be tightened or loosened as desired, wherein the screw 27 may be tightened sufficiently so that the rotor assembly 12 is essentially locked in place and cannot rotate in relation to the rest of the athletic shoe 100, the screw 27 may be only nominally tightened such that the torque-dampening system provides an insignificant level of braking (i.e., the rotor assembly 12 can freely rotate in relation to the rest of the athletic shoe 100), or the screw 27 may be tightened to any degree in between these extremes. Thus, the wearer can adjust the degree of tightening of the screw 27 to set the level of torque-dampening effect. In one embodiment, the torque-dampening effect may be supplied solely by the frictional interaction of the coil spring with the bottom surface of the rotor 14, however the invention is not so limited and other/additional torque-dampening means may be employed. For example, in one embodiment at least a portion of the circumferential inner surface 42 of socket 25 may be beveled whereby as rotor 14 is advancingly tightened toward the surface 43 of socket 25 at least a portion of the circumferential edge 41 of rotor 14 engages at least a portion of the circumferential inner surface 42, thereby providing a torque-dampening effect.

In other embodiments (not shown), torque-dampening may be provided from above upper surface 24 of rotor 14. In one such embodiment, one or more lip components, which may be affixed to or integral with shoe bottom 10 proximate, but outside of, socket 25 are provided. In one such embodiment, at least on such lip component extends at least partially over (above) rotor 14 surface 24. In such an embodiment, a lip component may comprise one or more protrusions that extend downward toward surface 24. In one aspect, the protrusions may contact a portion of surface 24, which may be substantially planar or comprise irregular surface geometry, and when the rotor assembly turns in relation to the rest of the athletic shoe 100 these protrusions serve to provide braking to such relative rotation consistent with the teachings disclosed herein. In one such embodiment, the lip component comprises an orifice, which may be internally threaded, wherein a lip component screw may be cooperatively engaged with the internal threading such that the screw can be controllably advanced toward and away from surface 24, whereby the degree to which the screw is advance through the lip orifice controls the amount of pressure the screw tip applies against surface 24, thereby controlling magnitude of torque-dampening. In one such embodiment, the screw may be countersunk into an upper surface of the lip. In one embodiment, at least the tip of such a screw may comprise a material having a Shore scale hardness greater than that of the portion of the rotor 14 surface 24 with which the screw contacts.

In another embodiment (not shown), which combines a torque-dampening apparatus located beneath the rotor assembly 12 with one or more lip component extending at least partially over (above) rotor 14 surface 24, the lip component screw(s) may be utilized to provide a compressing force (through rotor 14) to a compressible component, such as, but not limited to, a coil spring compressingly sandwiched between socket 25 surface 43 and a bottom surface of rotor 14. In such an embodiment, instead of a centrally disposed screw 27, the lip screw(s) provide the controllable force to create and adjust the torque-dampening effect, as would be understood by one skilled in the art.

In an alternatively configured embodiment (not shown), the torque-dampened rotational system 11 comprises a rotor 14 comprising a circumferential edge 41 comprising a plurality of deflectable elongate members (paddles) extending radially outward therefrom, and the torque-dampening apparatus 13 comprises a positionally stable engagement portion 34. In such an embodiment, the paddle is on the rotor and during engagement thereof with the engagement portion 34 deflection of the paddle can occur, and when sufficient deflection has occurred such that the torque-dampening apparatus 13 is able to move past the paddle, the paddle "swings" back into its initial orientation, and the engagement portion 34 can engage either the adjacent tooth paddle (if the rest of athletic shoe 100 rotation continues in the same direction) or the opposite side of the same paddle (if the rest of the athletic shoe 100 begins to rotate in the reverse direction).

Operation

Generally, an embodiment of an athletic shoe 100 of the present invention that comprises an embodiment of a torque-dampened rotational system 11 may be utilized to provide the wearer with a means of reducing stress on his/her lower body when locomotive movement requires a sudden change in direction. In one embodiment, the wearer's shoe can be equipped with a torque-dampening apparatus 13 and/or 13', wherein the force required to rotationally advance the torque-dampening apparatus 13 and/or 13' relative to the rotor 14 when the wearer, placing weight on the metatarsal region of the foot, changes direction is set at a specific level. In one embodiment, the force setting of a torque-dampening apparatus 13, for example, (which depends at least on the geometry and orientation of the teeth 16 and the compression strength of the torque-dampening apparatus 13 compressible member) may be customized. In one aspect, such force setting customization may take into account one or more of the sport/activity in which the wearer is to be participating, the surface on which the shoe will be worn, the wearers height and/or weight, and the traction component(s) of the rotor assembly 12 (i.e., cleats, studs, frictional surface, etc.). This allows the wearer to control which rotational movements will effectuate a rotation of the rest of athletic shoe 100 relative to rotor 14 and which rotational movements will not effectuate such a rotation.

In one embodiment, a person desiring to wear a pair of athletic shoes 100 will select the shoe type required for his/her sport/activity, wherein the shoes have been configured and adapted to house a torque-dampened rotational system 11, and equip the shoes therewith. In another embodiment, an athletic shoes 100 may be provided to the wearer already equipped with a torque-dampened rotational system 11. In either embodiment, the wearer will place the athletic shoes 100 on his/her feet and wear them to participate in the sport/activity. In either of these embodiments, the exchangeability of the torque-dampened rotational system 11 (including, independently, the rotor assembly 12 and the torque dampening apparatus 13, 13') of an athletic shoe 100 allows for changes in functionality thereof as may be desired by the wearer.

In an exemplary embodiment, which comprises use of athletic shoes 100 to participate in a sport/activity that takes place on a turf (natural or artificial) surface, during movement the wearer may implant one or more of the rotor assembly 12 cleats 8 into the turf. If the wearer pivots (changes direction of movement), the rest of athletic shoe 100 will turn in relation to the rotator assembly 12, whereby the ball 36 will engage one or more teeth 16 (depending on the degree of pivoting) such that the tooth/teeth 16 will rapidly engage with and disengage from the ball 36 of the ball plunger 13. In one aspect, the all of the engaging/disengaging tooth advancements that occur during a single pivoting movement can take place in period of time it takes the wearer to accomplish the pivot. As the ball 36 engages each tooth 16, the ball 36 will begin to depress the compressible member of the ball plunger 13. If the depressing force causes the ball 36 to relocate a sufficient distance away from the rotor 14, the ball plunger 13 will rotationally advance beyond that tooth. As the ball plunger 13 advances beyond each tooth 16, the ball plunger 13 will experience several retract-and-release "clicks" of the ball 36. The force dissipation through each "click" will progressively dampen the remaining force of the pivot, and thereby provide a "braking effect." Such a braking effect protects the wearer's muscles, tendons, ligaments, etc. from extreme forces and allows for a more controlled, natural rotation of the rest of the athletic shoe 100, and therefore, the wearer's foot, independent of the cleat(s) 8 imbedded in the turf.

As disclosed above, the amount of force required to actuate the torque-dampening apparatus 13 or 13' can be varied to suit the shoe wearer's needs, as would be understood by one skilled in the art. Accordingly, an athletic shoe 100 can be customized for each wearer. In addition, as the torque-dampened rotational system 11 of an athletic shoe 100 can be readily removed and replaced, an athletic shoe 100 can be further customized for the wearer during his/her participation in a particular sport/activity. For example, if the surface condition of the turf changes (e.g., it starts to rain), the torque-dampened rotational system 11 can be exchanged with another one that has a torque-dampening capability more suited to the wet turf condition.

Method

An exemplary method of utilizing an embodiment of an athletic shoe 100 of the present invention comprises A Shoe Provision Step, comprising putting on at least one athletic shoe, such as an athletic shoe 100, which comprises a torque-dampened rotational system, such as a torque-dampened rotational system 11, that comprises a torque-dampening apparatus, such as a torque-dampening apparatus 13; and A Pivoting Movement Step, comprising locomoting by foot on a surface so as to change direction, wherein such a change in direction actuates the torque-dampened rotational system such that a rotor assembly thereof remains stationarily in contract with the surface while the rest of the athletic shoe pivots in the direction of the change in direction as long as the engagement force of the torque-dampening apparatus against the rotor assembly actuates the torque-dampening apparatus, and once the engagement force diminishes such that the engagement force no longer actuates the torque-dampening apparatus, the athletic shoe does not rotate relative to the rotor assembly.

The foregoing method is merely exemplary, and additional embodiments of a method of utilizing an embodiment of an athletic shoe of the present invention consistent with the teachings herein may be employed. In addition, in other embodiments, one or more of these steps may be subdivided, performed concurrently, combined, repeated, re-ordered, or deleted, and/or additional steps may be added.

The foregoing description of the invention illustrates exemplary embodiments thereof. Various changes may be made in the details of the illustrated construction and process within the scope of the appended claims by one skilled in the art without departing from the teachings of the invention. Disclosure of existing patents, publications, and/or known art incorporated herein by reference is to the extent required to provide details and understanding of the disclosure herein set forth. The present invention should only be limited by the claims and their equivalents.

I claim:

1. A rotatable shoe comprising:

a torque-dampened rotational system positioned at least partially on or partially in a shoe bottom surface;

wherein:

said torque-dampened rotational system comprises:

a torque-dampening apparatus; and a rotor assembly comprising a rotor;

said rotor assembly is affixed to or integral with said shoe bottom;

said rotor assembly rotates independently from the rest of said shoe; and said torque-dampening apparatus engages with a plurality of protrusions on a circumferential edge of said rotor to resist rotation of said rotor assembly.

2. The rotatable shoe of claim 1, wherein the degree of rotation of said rotor assembly is not limited by said torque-dampening apparatus.

3. The rotatable shoe of claim 1, wherein the degree of rotation of said rotor assembly is limited by a stop member.

4. The rotatable shoe of claim 1, wherein said rotor assembly comprises one or more cleats affixed to or integral with said rotor.

5. The rotatable shoe of claim 1, wherein said torque-dampening apparatus comprises a ball plunger.

6. The rotatable shoe of claim 5, wherein said ball plunger is at least partially disposed in a pocket.

7. The rotatable shoe of claim 1, wherein the plurality of protrusions comprises of a plurality of teeth.

8. The rotatable shoe of claim 1, wherein said rotor assembly is positioned at least partially within a shoe bottom socket.

9. The rotatable shoe of claim 8, wherein at least a portion of said torque-dampening apparatus is disposed intermediate said rotor and a surface of said shoe bottom socket.

10. The rotatable shoe of claim 9, wherein said torque-dampening apparatus comprises a coil spring.

11. The rotatable shoe of claim 1, wherein said torque-dampening apparatus comprises at least one paddle that engages with a circumferential edge of said rotor.

12. The rotatable shoe of claim 1, wherein at least a portion of said torque-dampened rotational system is reversibly installed in said shoe.

13. The rotatable shoe of claim 1, wherein said resistance to rotation of said rotor assembly is at least partially adjustable through manipulation of a connection component that participates in affixing said rotor assembly to said shoe.

14. The rotatable shoe of claim 1, wherein said resistance to rotation of said rotor assembly is at least partially effectuated by at least one feature selected from the group consisting of:

one or more protrusions disposed on an upper surface of said rotor;

one or more protrusions disposed on a bottom surface of said rotor; and one or more protrusions disposed on a circumferential edge of said rotor.

15. A rotatable shoe comprising:

a torque-dampened rotational system positioned at least partially on or partially in a shoe bottom surface;

wherein:

said torque-dampened rotational system comprises:

a torque-dampening apparatus comprising a ball plunger; and a rotor assembly comprising a rotor equipped with one or more cleats;

said rotor assembly is affixed to or integral with said shoe bottom;

said rotor assembly rotates independently from the rest of said shoe;

said torque-dampening apparatus engages with a plurality of protrusions on a circumferential edge of said rotor to resist rotation of said rotor assembly; and the degree of rotation of said rotor assembly is not limited by said torque-dampening apparatus.

16. The rotatable shoe of claim 15, wherein said rotor assembly is reversibly affixed to a hub disposed in a shoe bottom socket with an attachment apparatus comprising:

a screw;

a washer; and a hub receptacle.

17. The rotatable shoe of claim 15, wherein the plurality of protrusions comprises of a plurality of teeth.

18. The rotatable shoe of claim 15, wherein at least a portion of said torque-dampened rotational system is reversibly installed in said shoe.

19. The rotatable shoe of claim 15, wherein:

said rotor assembly is positioned at least partially within a shoe bottom socket; and said ball plunger is at least partially disposed in a pocket.

20. A method of using a rotatable shoe, comprising:

providing a rotatable shoe comprising:

a torque-dampened rotational system positioned at least partially on or partially in a shoe bottom surface;

wherein:

said torque-dampened rotational system comprises:

a torque-dampening apparatus; and a rotor assembly comprising a rotor;

said rotor assembly is affixed to or integral with said shoe bottom;

said rotor assembly rotates independently from the rest of said shoe; and said torque-dampening apparatus engages with a plurality of protrusions on a circumferential edge of said rotor to resist rotation of said rotor assembly;

placing said shoe on a foot; and locomoting by foot on a surface so as to change direction, wherein such a change in direction actuates said torque-dampened rotational system such that said rotor assembly thereof remains substantially stationarily in contract with said surface while the rest of said shoe pivots in the direction of said change in direction.

* * * * *